US008727606B2

(12) United States Patent
Kaelin et al.

(10) Patent No.: US 8,727,606 B2
(45) Date of Patent: May 20, 2014

(54) CONTROL DEVICE FOR A TIMEPIECE MECHANISM USING PRESSURE OR TRACTION

(75) Inventors: Laurent Kaelin, Sonvilier (CH); Julien Moulin, Volleges (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 13/586,465

(22) Filed: Aug. 15, 2012

(65) Prior Publication Data

US 2013/0044572 A1 Feb. 21, 2013

(30) Foreign Application Priority Data

Aug. 17, 2011 (EP) ..... 11177838

(51) Int. Cl.
*G04B 27/04* (2006.01)

(52) U.S. Cl.
USPC ..... 368/192; 368/319

(58) Field of Classification Search
USPC ..... 368/190–195, 319–321
See application file for complete search history.

(56) References Cited

U.S. PATENT DOCUMENTS 56,683 A * 7/1866 Lehmann ..... 368/192
228,987 A * 6/1880 Davis ..... 368/194
1,244,127 A 10/1917 Prihoda
2,919,537 A * 1/1960 Meyer ..... 368/193
3,421,311 A * 1/1969 Bennett et al. ..... 368/185

FOREIGN PATENT DOCUMENTS

| | | |
|---|---|---|
| CH | 140 164 | 8/1930 |
| DE | 14 02 863 | 4/1937 |
| JP | 50-91358 | 7/1975 |

OTHER PUBLICATIONS

European Search Report issued Feb. 9, 2012 in corresponding European Application No. 11 17 7838 filed Aug. 17, 2011 (with an English Translation).

* cited by examiner

*Primary Examiner* — Sean Kayes
(74) *Attorney, Agent, or Firm* — Oblon, Spivak, McClelland, Maier & Neustadt, L.L.P.

(57) ABSTRACT

Control mechanism (1) for loading an energy accumulator (20) for a timepiece (100) or a timepiece movement (10) via an intermediate winding mechanism (25), said mechanism (1) comprising a winding button (2) arranged to drive, at least in translation, a winding stem (3) which can occupy at least an initial longitudinal position (T0) for said energy loading.
A portion of the length of said stem (3) is ringed or threaded, to pivot and/or drive in translation a winding driving means (4), when said stem is moved in translation as a result of pressure or traction by the user, in a limited travel between said initial position (T0) and an unstable maximum pushed-in or respectively pulled-out position (TL) of said stem (3), which is returned to said initial position (T0) by elastic return means (5),

10 Claims, 9 Drawing Sheets

CONTROL DEVICE FOR A TIMEPIECE MECHANISM USING PRESSURE OR TRACTION

This application claims priority from European Patent Application No. 11177838.7 filed Aug. 17, 2011, the entire disclosure of which is incorporated herein by reference.

FIELD OF THE INVENTION

The invention concerns a control mechanism for loading an energy accumulator for a timepiece or a timepiece movement via an intermediate winding mechanism, said winding mechanism comprising a winding stem and a winding-button arranged to drive said stem, at least in translation, wherein said stem can occupy at least an initial longitudinal position for said energy loading, a portion of the length of said stem is ringed or threaded, and said stem is arranged drive in rotation or/and translation a winding driving means, when said stem is moved in translation by pressure or traction by the user, in a travel which is limited between said initial longitudinal position and a maximum pushed-in or respectively pulled-out position of said stem, said maximum position being an unstable position, and said stem being returned to said initial position by an elastic return means.

The invention also concerns a timepiece movement fitted with a control mechanism of this type.

The invention also concerns a timepiece fitted with a movement or a control mechanism of this type.

The invention concerns the field of horology, and more specifically portable timepieces such as wristwatches, pocket watches or similar.

BACKGROUND OF THE INVENTION

In a conventional construction, manual winding occurs by rotation in a particular position of the stem.

The main drawbacks of the prior art are connected to the space requirement, complexity and cost of conventional winding mechanism designs, in particular:

- the existence of two expensive Breguet toothings on the castle wheel and the winding pinion;
- a 90 degree gearing between the winding pinion and the crown wheel;
- a control device that alternately meshes a castle wheel with the time-setting wheel and the winding pinion;
- a relatively large system height, due the large diameter of the winding pinion (larger diameter than the castle wheel) which meshes on the crown wheel;
- cut and stamped parts with several stages;
- numerous components.

There are various known improvements to conventional winding mechanisms via a key or the winding-button. However, very few Patent documents deal with types of winding mechanisms other than conventional or automatic winding mechanisms linked to numerous improvements.

In addition to the setting functions, some documents have used the axial movement of the stem to implement torque limiting mechanisms to prevent any damage to the movement during winding.

CH Patent No. 241 961 in the name of Breitling, discloses a winding-button pipe carrying a winding stem which is in two sections coupled to each other by hooks, and which are permanently integral in rotation, yet able to move axially in relation to each other from the travel of the pusher. This axial movement occurs as a result of axial pressure on the winding-button, which encloses a return spring to return the winding-button to a rest position, and the winding-button pushes a sleeve, in which two stem sections are fitted, abutting on the movement lever, with time-setting occurring in a conventional manner with the winding-button in the pulled-out position.

A variant Swiss Patent No. 241963 in the name of Breitling replaces these two stem sections with a stem pinned to a sliding sleeve comprising two opposite slots in which a connecting pin moves. The bottom end of the sleeve abuts in a similar manner on the lever.

A similar two-part stem configuration, cooperating with a spring integrated in the winding-button is also disclosed in FR Patent No. 923 922 in the name of Buechler, wherein the winding position is the neutral position of the winding-button, whereas the pushed-in position corresponds to another function, which consists in resetting a seconds hand via the winding stem.

A mechanism of this type is improved by WO Patent No. 2005/038538 in the name of Richemont and the object of the mechanism is to protect the movement from too high stresses by the spring, and the mechanism therefore includes a second compensating spring. Pressing on the winding-button pushes a tube onto the control member, controlling a chronograph or time zone function, whereas the winding function remains linked to a particular position of the winding-button.

U.S. Pat. No. 6,711,099 by Watch-U-License discloses an ultra-flat mechanism with discs whose axes are parallel to each other perpendicularly to the direction of the stem, in which a flat spring carries certain wheel sets, wherein pressure on the stem allows engagement or disengagement with other wheel sets.

WO Patent No. 2008/114 071 in the name of Lutolf discloses a means of energy storage in the form of a helical spring, which is wound either by a rack or directly by an ad hoc pinion. This driving member can be used, in particular, to wind the balance spring of a conventional barrel.

U.S. Pat. No. 1,244,127A in the name of PRIHODA discloses a pocket watch wound by pulling a stem, a shoulder of which pushes a pivoting toothed sector to drive a winding pinion.

German document DE 14 02 863 U in the name of SCHULER discloses a miniature clock mechanism wound by operating a stem including a rack and directly driving a winding pinion.

CH Patent Application No. 140 164 A in the name of JACCARD discloses a pull-out piece control mechanism with a to and fro motion, wherein the pull-out piece is either fitted with a rack, a click or a finger for controlling a pivoting toothed sector.

JP Patent Application No. 50 091358A discloses the cooperation of a fluted arbour operating in traction with a control pinion.

Various other elastic push-button devices are known, generally devised as winding limiters and comprising an uncoupling mechanism incorporating a spring along the direction of the stem.

It is not possible, with the various teaching, to obtain a compact winding mechanism at an economical production cost.

SUMMARY OF THE INVENTION

The invention proposes to overcome the problems and limitations of the prior art by proposing a compact control mechanism with an economical production cost, both as regards the components and assembly and adjustment costs of the mechanism.

The invention therefore concerns a control mechanism for reloading an energy accumulator for a timepiece or a timepiece movement via an intermediate winding mechanism, said winding mechanism comprising a winding stem and a winding-button arranged to drive said stem, at least in translation, wherein said stem is able to occupy at least an initial longitudinal position for said energy reloading, and a portion of the length of said stem is ringed or threaded, said stem is arranged to drive in rotation or/and in translation a winding driving means, when said stem is moved in translation by pressure or respectively traction by the user, in a travel which is limited between said initial longitudinal position and a maximum pushed-in or respectively pulled-out position of said stem, said maximum position being an unstable position, and said stem being returned to said initial position by elastic return means, characterized in that said winding driving means includes a means of driving said intermediate winding mechanism, and in that said driving means includes a disconnectable intermediate winding wheel for driving a winding train, comprised in said intermediate winding mechanism, said intermediate winding wheel being moveable along a travel parallel to that of said stem and remaining permanently meshed with said stem.

According to a feature of the invention, said winding-button is also arranged to pivot said winding stem which, in addition to said initial energy loading position via a movement of translation of said stem, is capable of occupying at least one other longitudinal position for adjusting a display mechanism by a pivoting movement of said stem.

According to another feature of the invention, said stem is arranged to drive, in a guide groove, directly or indirectly via at least a first lever, an arm of a pull-out piece arranged to control directly or indirectly via at least a second lever, the movement of a castle-wheel on translation guide means comprised in said stem, said castle-wheel has only one degree of freedom in translation relative to said stem and is integral in rotation therewith via rotational driving means, in order, depending upon the longitudinal position of said castle-wheel on said stem, either to mesh said castle-wheel with an adjusting wheel set for setting the display of a function of said timepiece or said timepiece movement, or to mesh said castle-wheel with a wheel set linked to another function of said timepiece or of said timepiece movement, or to move said castle-wheel into a neutral position in which it has no effect on the functions of said timepiece or said timepiece movement.

According to another feature of the invention, said elastic return means includes at least one spring integrated in at least one lever inserted between said stem and an arm of a pull-out piece controlling the movement of a castle-wheel.

According to yet another feature of the invention, said elastic return means includes at least one spring which works in compression or respectively in traction, to push or respectively pull said stem when the stem is pushed into said timepiece or respectively pulled out of said timepiece by the user, from said initial stable longitudinal position to said unstable maximum pushed-in or respectively pulled-out position of said stem, and said elastic return means also forms an element for indexing the longitudinal position of said stem in at least one other stable position, different from said initial position and for cooperating, via at least one notch, with a finger comprised in a pull-out piece actuated by said stem and controlling the movement of a castle-wheel.

According to another feature of the invention, said stem is arranged to pivot a disconnectable intermediate winding wheel for driving driving means of said intermediate winding mechanism, and said intermediate winding wheel is moveably mounted and able to occupy two positions. One is a gearing position in which it is meshed with said driving means when said stem moves in translation in a first direction of winding as a result of pressure or respectively traction by the user against said elastic return means. The other is a disengaging position in which the intermediate winding wheel is disengaged from said driving means when said stem moves in translation in a second, return direction opposite to said first winding direction as a result of said elastic return means.

According to another feature of the invention, said intermediate winding wheel includes a cylindrical hole guided on an arbour of almond shaped section, which allows said wheel to occupy said gearing position when said bore abuts on a first surface of said arbour, and said disengaging position when said bore abuts on a second surface, opposite said first surface.

According to another feature of the invention, said intermediate winding wheel includes an arbour which can move in an oblong hole in a bar or a bottom plate, between two stop members; allowing the wheel to occupy said gearing position when said arbour abuts on a first stop member of said oblong hole, and said disengaging position when said arbour abuts on a second stop member of said oblong hole.

According to another feature of the invention, said stem is arranged to pivot a winding lever which is able to occupy two positions. The first is a gearing position in which it is meshed with a winding train or with said barrel ratchet when said stem moves in translation in a first winding direction as a result of pressure or traction by the user against said elastic return means. The other position is a disengaging position in which the lever is disengaged from said winding train or said ratchet when said stem moves in translation in a second, return direction opposite to said first winding direction as a result of said elastic return means.

According to yet another feature of the invention, said elastic return means is formed by said winding lever which is a flexible lever.

According to another feature of the invention, said winding lever includes a first oblong hole, substantially parallel to said stem, which cooperates with a first pin of a bar or bottom plate, and a second substantially triangular hole, which cooperates with a second pin of a bar or bottom plate. Said second hole provides said winding lever with a slight angular clearance with respect to the direction of said stem and the combination of the relative motions between said winding lever and said first pin, on the one hand, and with said second pin on the other hand, allows an end tooth comprised in said winding lever to enter into cooperation with a toothing comprised in said barrel ratchet in a first direction of translation of said stem for winding, and allows the exit of said end tooth from said toothing in the second direction of translation of said stem opposite to said first direction.

The invention thus overcomes the problems of the prior art and provides an original design by replacing movements of rotation with movements of translation.

The invention also concerns a timepiece movement fitted with a winding mechanism of this type.

The invention also concerns a timepiece including at least one winding mechanism of this type or one movement of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

The invention concerns the field of horology, and more specifically portable timepieces such as wristwatches, pocket watches or similar.

The invention more particularly concerns a control mechanism 1. The invention is more particularly described here for the preferred case of a winding mechanism. It is, however, applicable to the control of other mechanisms, particularly for adjusting the set hands, date or any display mechanism.

Figure 1:
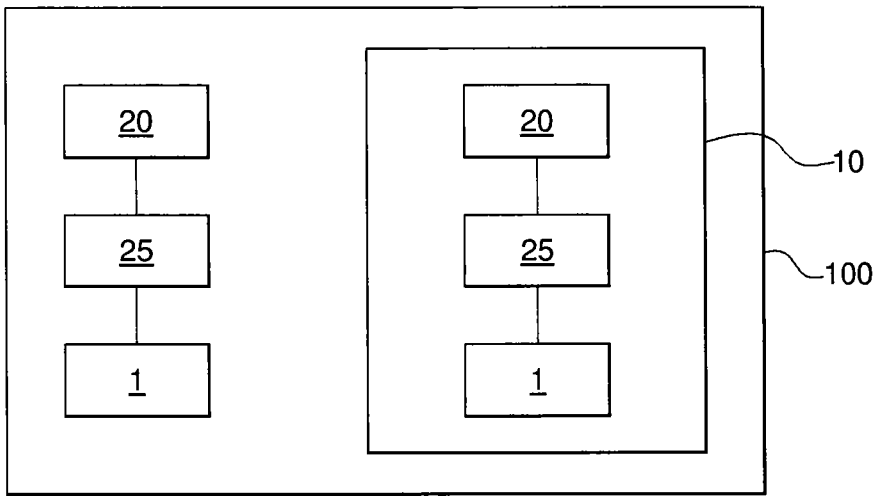
FIG. 1 shows, in the form of block diagrams, a timepiece comprising a movement, an energy accumulator and a winding control mechanism according to the invention.

In this particular application, control mechanism 1 is devised as a winding mechanism for loading an energy accumulator 20 for a timepiece 100 or a timepiece movement 10, via an intermediate winding mechanism 25, as seen in the block diagrams of FIG. 1. This intermediate winding mechanism 25 preferably includes a winding gear train 21 or a barrel ratchet 22.

The invention is illustrated, in particular, in the case where the energy accumulator 20 is a barrel 220 for a timepiece 100 wound by a barrel ratchet 22.

Control mechanism 1 includes a winding-button 2, which is arranged to drive a winding stem 3 at least in translation. This stem 3 is capable of occupying at least one initial longitudinal position T0 for energy loading.

Figure 2:
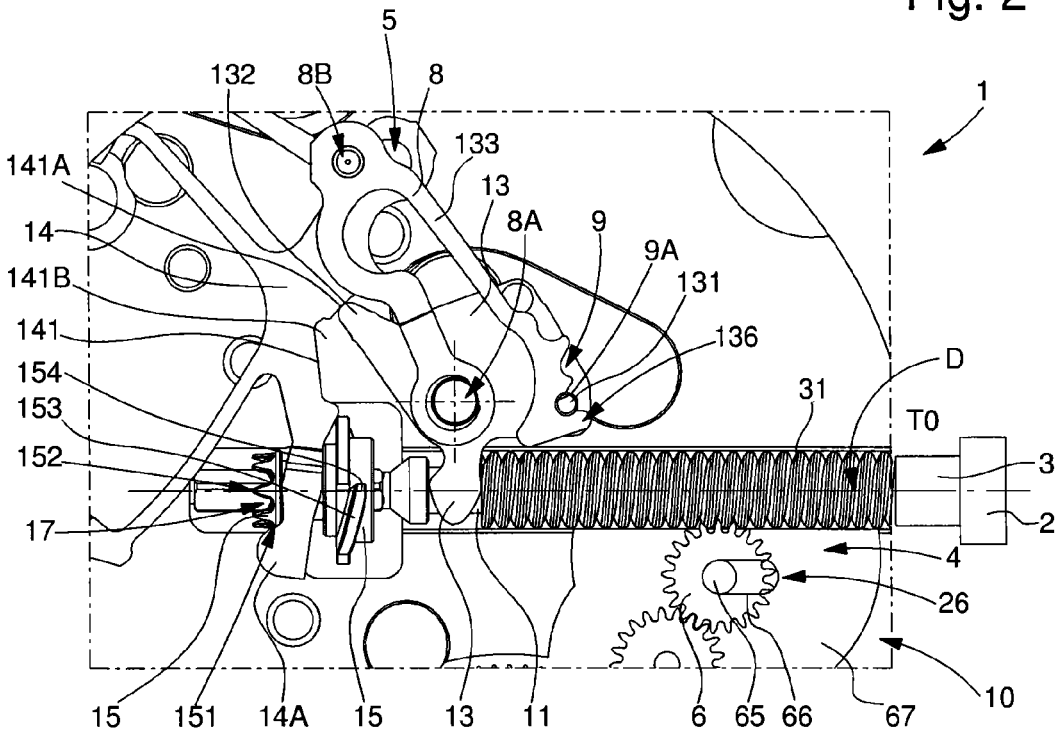
FIG. 2 shows a schematic, partial, front view of a first variant of a winding mechanism according to the invention, wherein a winding stem includes a threaded portion, in an initial position allowing winding via pressure on a winding-button fixed to the stem.
Figure 3:
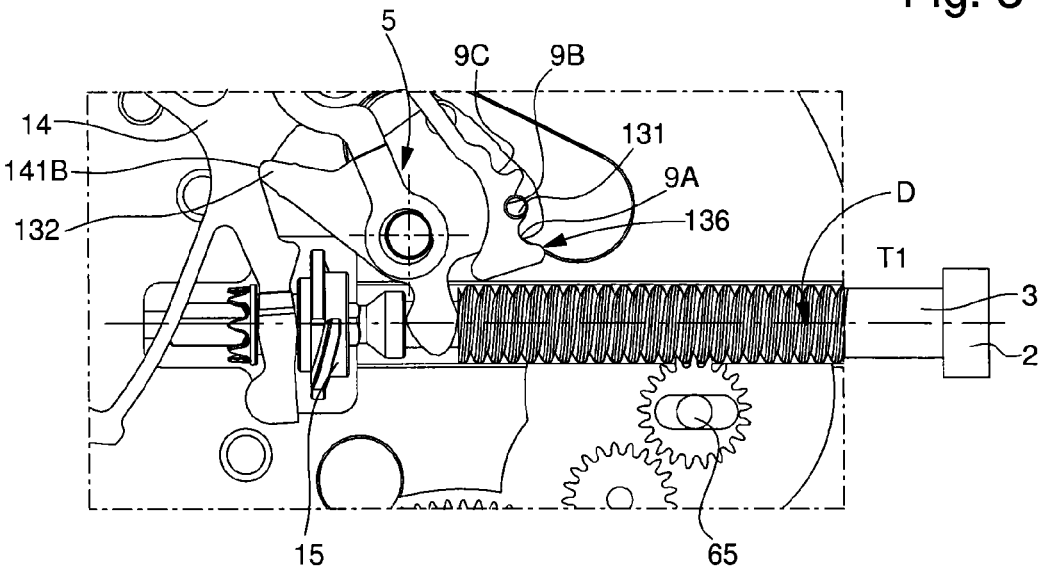
FIG. 3 shows, in a similar manner to FIG. 2, the same mechanism in a first pulled-out position of the stem, which is a date setting position in which it is not possible to wind the timepiece by pressing.
Figure 4:
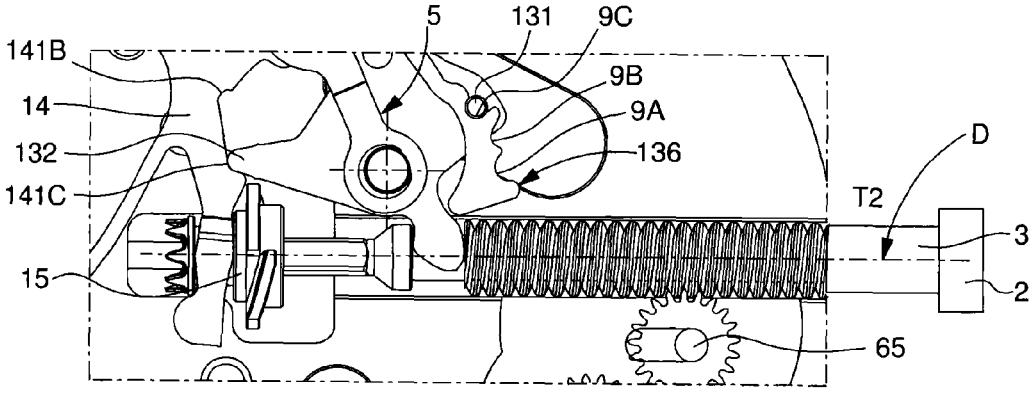
FIG. 4 shows, in a similar manner to FIG. 2, the same mechanism in a second pulled-out position of the stem, which is a set-hands position in which it is not possible to wind the timepiece by pressing.
Figure 5:
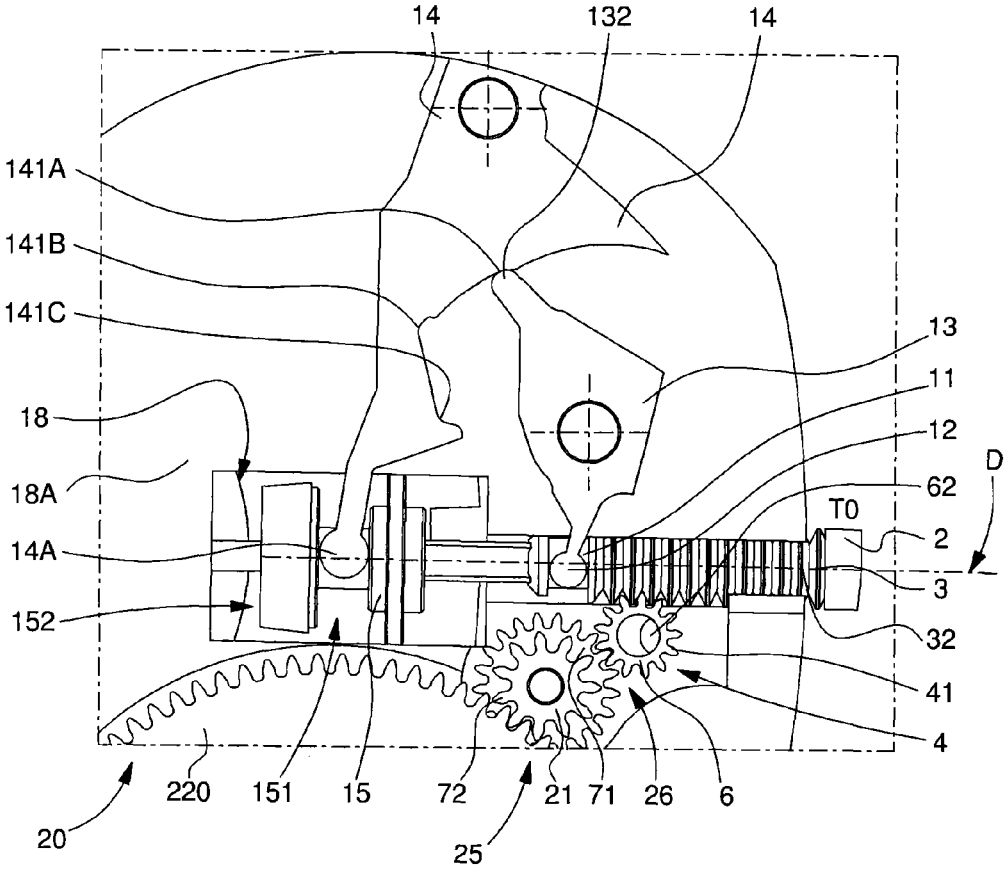
FIG. 5 shows a schematic, partial, front view of another variant of a winding mechanism according to the invention, wherein a winding stem includes a ringed portion, in an initial position allowing winding by pressure on a winding-button fixed to the stem.

According to the invention, a portion of the length of stem 2, is a ringed stem 32, as seen in FIGS. 5 to 9, or a threaded stem 31, as seen in FIGS. 2 to 4, and the stem is arranged to drive in rotation or/and in translation winding driving means 4, when stem 3 is moved in translation, along a direction D, as a result of pressure or respectively traction by the user, in a travel which is limited between the initial longitudinal position T0 and a maximum pushed-in or pulled-out position TL of stem 3. This end position TL is an unstable position. Stem 3 is returned to the initial position T0 by elastic return means 5.

The invention is described here with the preferred application of a longitudinal rectilinear movement of stem 3 in a longitudinal direction D, but naturally it can also apply to a curvilinear stem 3 moving along a curved contour, in particular a circular contour. The movement of translation is then replaced by a pivoting movement.

The invention is also described and illustrated only in the preferred configuration where the winding means is driven as a result of pressure by the user. The opposite case of energy provided by traction, although possible, is less convenient for the user, and changes the sequence of positions which will be described below.

According to the invention, winding driving means 4 includes a means 26 of driving intermediate winding mechanism 25. Various cases may arise:

- if energy accumulator 20 is loaded by this type of winding train 21, drive means 26 includes a disconnectable intermediate winding wheel 41 for driving winding train 21;
- or, if energy accumulator 21 is loaded via a lever or this type of barrel ratchet 22, drive means 26 includes a winding lever 42 for driving barrel ratchet 22.

Winding-button 2 is preferably still arranged to pivot winding stem 3, which, in addition to initial position T0 for loading energy by a movement of translation of the stem, is capable of occupying at least one other longitudinal position T1, T2 . . . , for setting a display mechanism by a pivoting movement of stem 3.

The invention is illustrated here in a non-limiting manner for a stem 3 occupying three positions T0, T1, T2. Naturally, the same stem 3 could occupy other positions for controlling additional functions.

In a particular application, winding-button 2 is mounted integral with winding stem 3. It may also be removable or drive stem 3 indirectly.

In another particular application, which is not illustrated in the Figures, movement 10 includes two stems, one for the setting functions, particularly for setting the date and time, and the other only for winding, which may be formed by a push-button. With this two-stem configuration, it is possible therefore to have a stem which only performs the winding function in a single position T0.

Stem 3 is arranged to drive, by a guide groove 11, directly or indirectly via at least a first lever, a first arm 12 of a pull-out piece 13. This pull-out piece 13 is arranged to control, directly or indirectly via at least a second lever 14, and in particular via an arm 14A of said second lever 14, the movement of a castle-wheel 15 on a translation guide means 16 comprised in stem 3.

This castle-wheel 15 cooperates with arm 14A by a groove 141 comprised therein, and has only one degree of freedom in translation relative to stem 3, and rotates integrally therewith via a rotational driving means 17, in order, according to the longitudinal position of castle-wheel 15 on stem 3, either to mesh castle-wheel 15 with a setting wheel set 18 for setting the display of a function of timepiece 100 or movement 10, or to mesh castle-wheel 15 with a wheel set linked to another function of timepiece 100 or movement 10, or to bring castle-wheel 15 into a neutral position in which it has no effect on the functions of timepiece 100 or movement 10.

Rotational driving means 17 can be formed by an internal female splined groove cooperating with an external male splines groove of stem 3, or a similar element. The Figures illustrate the usual driving configuration via a square of stem 3.

Preferably, at least one setting wheel set 18 is a minute wheel set 18A for setting the time of a timepiece 100 or a timepiece movement 10.

In a particular embodiment, not shown in the Figures, castle-wheel 15 is arranged to cooperate, in one of the longitudinal positions thereof other than the initial winding position T0, with another winding wheel set directly or indirectly driving another barrel ratchet. A variant of the invention may thus provide for the several different accumulator members, for example a first barrel driving the movement and a second barrel driving a striking mechanism, to be wound by different actions by the user on the winding-button: winding one of the energy accumulators by pressure or traction when the stem is in the initial position T0, and winding another accumulator when stem 3 is in another position Ti in which it is operated in rotation by the user. It will be noted that the other accumulator may also be wound when stem 3 is in position T0.

In a particular embodiment, elastic return means 5 includes at least one spring 8. This embodiment is not exclusive, and elastic return means 5 may take other forms without departing from the scope of the invention.

Figure 13:
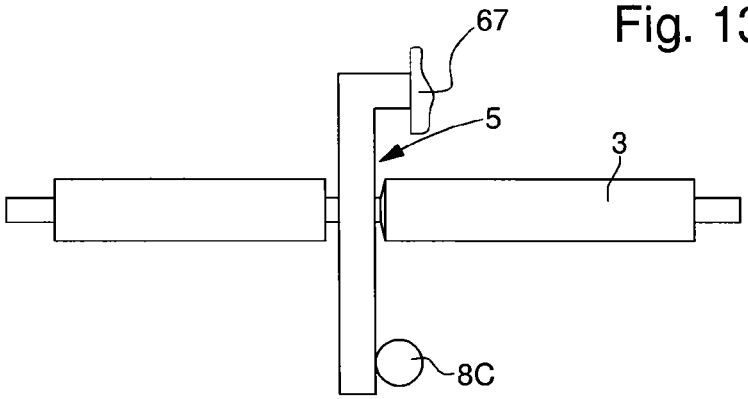
FIG. 13 shows a schematic, partial, front view of a detail of another spring forming an elastic return means for the stem which can be used in the different variants.
Figure 14:
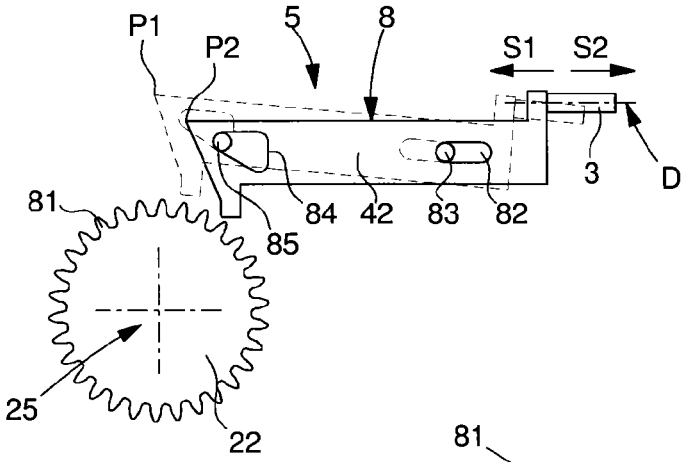
FIG. 14 shows a schematic, partial, front view of a detail of a mechanism according to the invention wherein the stem operates a winding lever in translation to drive an intermediate winding mechanism.
Figure 15:
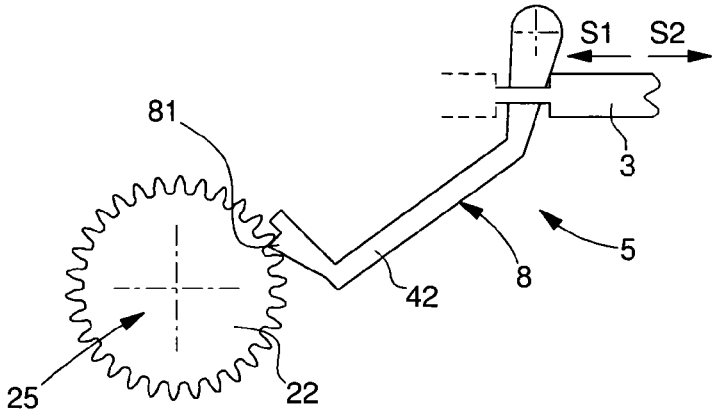
FIG. 15 shows a schematic, partial, front view of a detail of a mechanism according to the invention wherein the stem operates another winding lever variant in rotation to drive an intermediate winding mechanism.
Figure 16:
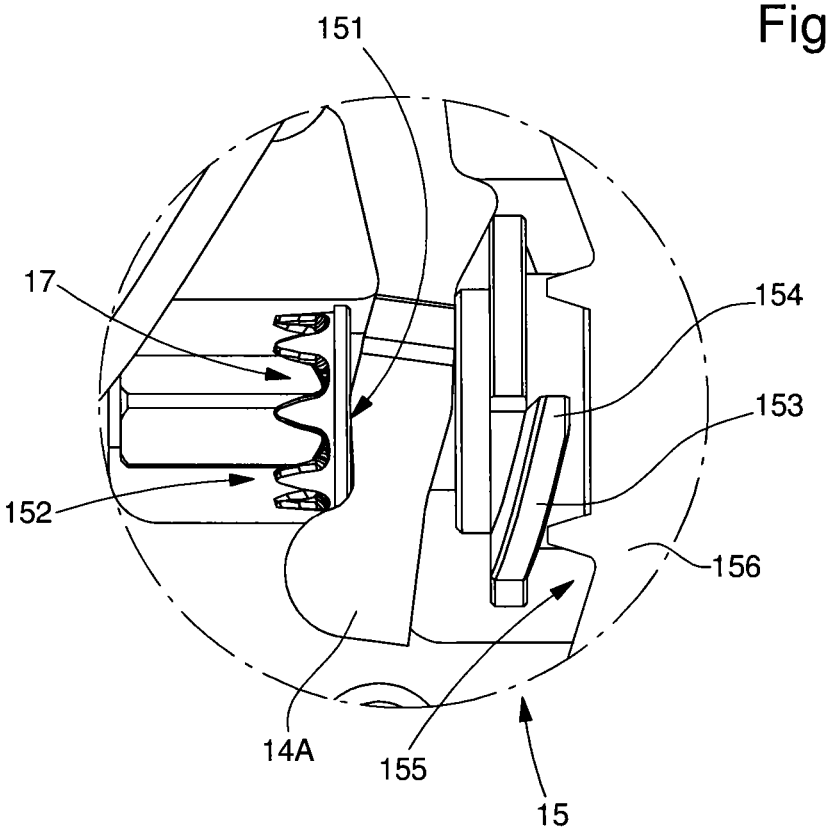
FIG. 16 shows a schematic view of a castle-wheel incorporated in the variants of the invention illustrated in FIGS. 2 to 9.

This spring 8 may be arranged in various ways, and particularly, in a non-limiting manner, in the following arrangements:

- integrated in the second lever 14, as seen in FIGS. 2 to 4, where spring 8 is a pull-out piece spring 133 which is secured to a main pivot 8A which, in this non-limiting version, is also the pivot of pull-out piece 13, and which is also fixed to a secondary pivot 8B about which the lever pivots. In this preferred embodiment, pull-out piece spring 8 does not pivot;
- spring 8 is an integral part of a winding lever 42, or is coupled thereto, as seen in FIGS. 14 and 15;
- spring 8 is fixed to a bottom plate 67 and pre-stressed by a stop member 8C. It cooperates with a shoulder of stem 3, as seen in FIG. 13;

In yet another variant, spring 8 may be integrated in second lever 14, or hinged on said second lever 14, and pivot both about this main pivot 8A, and about a secondary pivot 8B mounted integral with second lever 14.

In a preferred variant, elastic return means 5 includes at least one spring 8 working both in compression, or traction respectively, to push back, or respectively pull out, stem 3 when it is pushed into timepiece 100 or movement 10, or respectively pulled out of timepiece 100 or movement 10 by the user from the initial stable longitudinal position T0 to the unstable position TL where stem 3 is pushed in or respectively pulled out as far as possible. Elastic return means 5 also forms an element for indexing the longitudinal position of stem 3 in at least one other stable position other than initial position T0 and cooperating, via at least one notch 9, with a finger 131 comprised in pull-out piece 13 activated by stem 3 and controlling the movement of a castle-wheel 15. FIGS. 2 to 4 and 12 illustrate this type of spring 8, which includes notches 9A, 9B, 9C, which are arranged to cooperate with finger 131 of pull-out piece 13 to lock stem 3 in a stable position respectively in positions T0, T1 and T2. A ramp 136 is used for returning stem 3. Advantageously, this ramp 136 is arranged to prevent any over-travel as a result of excessive stress by the user.

In a particular embodiment illustrated in the Figures, stem 3 is arranged to pivot a disconnectable intermediate winding wheel 6 for driving driving means 26 of intermediate winding mechanism 25. Intermediate winding wheel 6 is moveably mounted and able to occupy two positions P1; P2: a gearing position P1, in which said wheel is meshed with driving means 26 when stem 3 moves in translation in a first winding direction S1 as a result of pressure or respectively traction by the user against elastic return means 5, and a disengaging position P2, in which it is disengaged from driving means 26 when stem 3 moves in translation in a second direction of return S2, opposite to first winding direction S1 by elastic return means 5.

In a variant, this intermediate winding wheel 6 only cooperates with one winding train or with ratchet 22 and it has a simple toothing, which is arranged to cooperate both with a stem 3, ringed stem 32 or threaded stem 31 on the one hand, and with the intermediate ratchet wheel on the other hand. This intermediate winding wheel 6 does not have a Breguet toothing and does not cooperate with castle-wheel 5. The axis of intermediate winding wheel 6 is perpendicular to a bar or bottom plate 67 of movement 10.

Preferably, the travel along which stem 3 moves in translation in a first winding direction S1 as a result of pressure by the user against elastic return means 5, is performed between the initial stable pushed-in position T0 and another unstable position TL in which stem 3 is still further pushed into timepiece 100.

In a particular embodiment of the invention, intermediate winding wheel 6 is arranged to cooperate in a coupled position with a meshing intermediate wheel 7 of intermediate winding mechanism 25, in particular a meshing intermediate wheel 7 of a barrel ratchet 22 arranged to wind a barrel 220.

In the variant illustrated in FIGS. 5 to 9, and 10A to 10C, intermediate winding wheel 6 has a cylindrical bore 61 guided on an arbour of almond-shaped section 62 allowing it to occupy gearing position P1 when bore 61 abuts on a first surface 63 of arbour 62, and to occupy the disengaging position P2 when bore 61 abuts on a second surface 64 opposite to first surface 63. When stem 3 is returned by elastic return means 5, particularly a spring 8, intermediate winding wheel 6 is abutting on an inner portion of almond-shaped arbour 62, which has the effect of disengaging said wheel from the intermediate meshing wheel of the ratchet.

In a particular embodiment of the invention, the travel of intermediate winding wheel 6 relative to almond-shaped arbour 62 is less than half the radius of cylindrical bore 61.

In another variant illustrated in FIGS. 2 to 4 and 11A to 11D, intermediate winding wheel 6 includes an arbour 65 moving in an oblong hole 66 of a bar or a plate 67 between two stop members 68 and 69, allowing said wheel 6 to occupy gearing position P1 when arbour 65 abuts on a first stop member 68 of said oblong hole 66, and disengaging position P2 when arbour 65 abuts on a second stop member 69 of oblong hole 66.

In a particular embodiment of the invention, the travel of intermediate winding wheel 6 relative to oblong hole 66 is less than half the radius of arbour 65 of intermediate winding wheel 6.

In a particular embodiment, shown in FIGS. 5 to 9, in a version where stem 3 is a ringed stem 32, intermediate winding wheel 6 cooperates with a winding train 21, which comprises a first toothing 71, arranged to cooperate with intermediate wheel 6, and a second toothing 72, arranged to cooperate with the intermediate winding mechanism 25, in particular with an intermediate meshing wheel of barrel ratchet 22.

In another particular embodiment, intermediate winding wheel 6 includes a single toothing arranged to cooperate, on the one hand, with ringed stem 3, and on the other hand, with this intermediate meshing wheel of barrel ratchet 22.

According to a particular and preferred embodiment of the invention, the only connection between intermediate winding wheel 6 and castle-wheel 5 is indirect in nature and provided by stem 3, which, on the one hand, carries castle-wheel 5 and drives said pinion in rotation when wheel 6 is moved in rotation, and which, on the other hand, drives intermediate winding wheel 6, or a winding lever 42, pivoting when the wheel is moved in translation.

Intermediate winding wheel 6 is preferably pivotally moveable about an axis perpendicular to a bar or bottom plate 67 comprised in mechanism 1.

In another particular embodiment of the invention, as seen in FIGS. 14 and 15, stem 3 is arranged to drive in rotation or/and in translation a winding lever 42. This winding lever 42 can occupy two positions P1 and P2; a gearing position P1 in which it is meshed, as a result of the motion, directly or indirectly, with a barrel ratchet 22 when stem 3 is moved in translation in a first winding direction S1 as a result of pressure or traction by the user against elastic return means 5, and a disengaging position P2 in which it is disengaged from the intermediate meshing wheel of the ratchet when the stem is moved in translation in a second, return direction S2, opposite to first winding direction S1, by elastic return means 5.

FIG. 15 illustrates a variant in which stem 3 simply pivots winding lever 42.

In an advantageous embodiment, elastic return means 5 is integrated in the actual winding lever 42. In a particular variant, winding lever 42 is a flexible lever.

In a particular embodiment of the invention, this flexible lever 42 cooperates with barrel ratchet 22. In a particular embodiment, it includes an end tooth 81 forming a click, which is arranged to cooperate with barrel ratchet 22.

In the variant illustrated in FIG. 14 and essentially corresponding to translation kinematics, winding lever 42 includes an end tooth 81. Winding lever 42 further includes a first oblong hole 82, substantially parallel to stem 3, which cooperates with a first pin 83 of a bar or bottom plate 67, and a second substantially triangular hole 84, which cooperates with a second pin 85 of a bar or bottom plate. This second hole 85 provides winding lever 42 with a slight clearance, on the order of 0 to 10°, relative to direction D of stem 3, and the combination of relative movements between winding lever 42 and first pin 83, on the one hand, and with second pin 85 on the other hand, allows end tooth 81 to enter into cooperation with a toothing of barrel ratchet 22 in a first direction S1 of translation of the stem for winding, and allows the exit of end tooth 81 in the second direction of translation S2 of stem 3, opposite to first direction S1. In this variant of FIG. 14, the kinematics between stem 3 and winding lever 42 occurs essentially in translation, since the pivoting component is used only for disengaging on the return travel.

Figure 17:
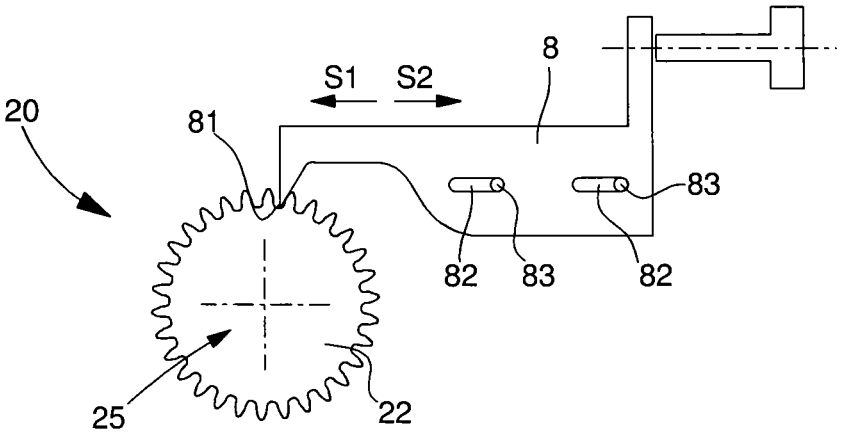
FIG. 17 shows a schematic, partial, front view of a detail of a mechanism according to the invention wherein the stem operates a winding lever solely in translation to drive an intermediate winding mechanism.

FIG. 17 illustrates a variant with purely translation kinematics. Spring 8 is guided by two holes 82 which are parallel to each other on two pins 83 of a bar or bottom plate 67 and it includes a beak 81. This spring 8 is rigid to buckling in the first direction S1 of translation of the stem for winding, and flexible in traction in the second direction of translation S2 of stem 3, opposite to first direction S1, which then allows it to be disengaged from ratchet 22.

Figure 8:
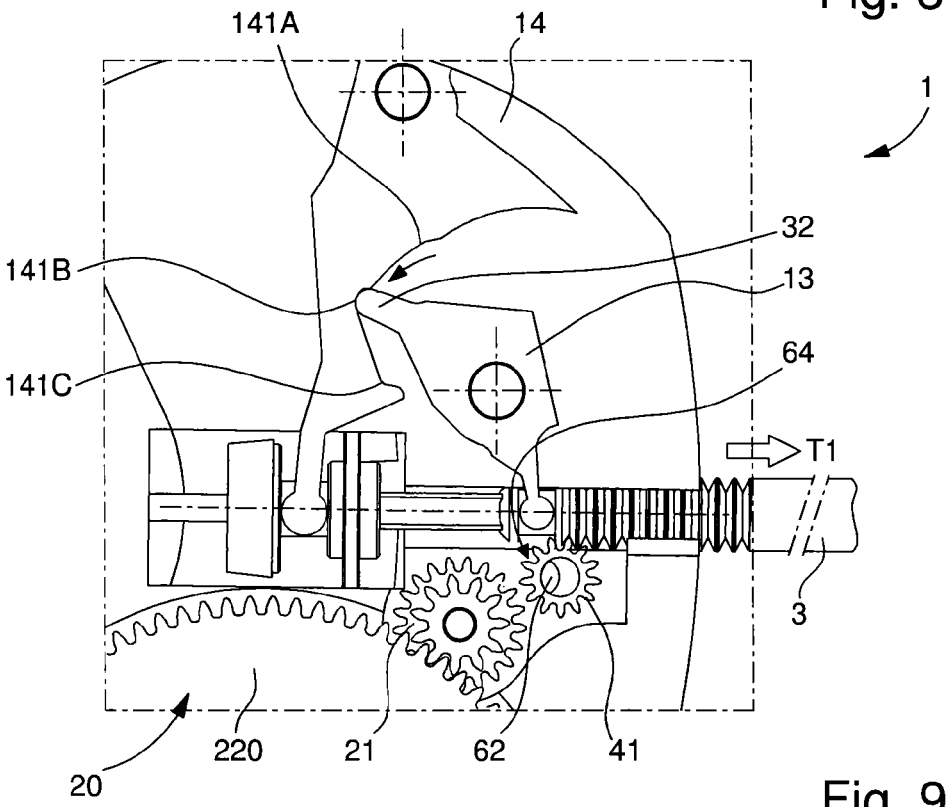
FIG. 8 shows, in a similar manner to FIG. 5, the same mechanism in a first pulled-out position of the stem, which is a date setting position in which it is not possible to wind the timepiece by pressing.
Figure 9:
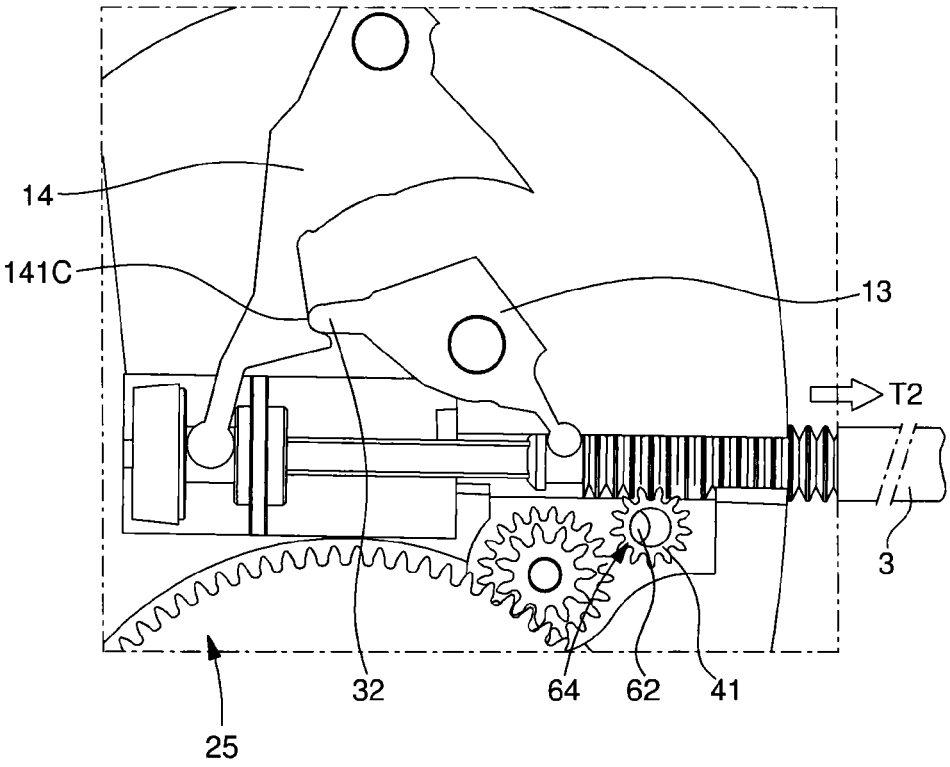
FIG. 9 shows, in a similar manner to FIG. 5, the same mechanism in a second pulled-out position of the stem, which is a set-hands position in which it is not possible to wind the timepiece by pressing.
Figure 10A:
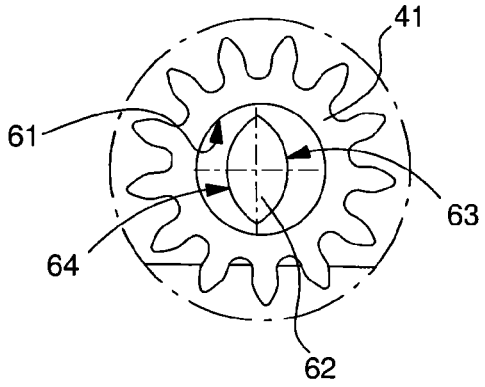
FIGS. 10A, 10B, 10C show schematic, partial, front views of a detail of a mechanism for coupling or uncoupling the stem relative to an intermediate winding mechanism, in the variant of FIGS. 5 to 9.
Figure 10B:
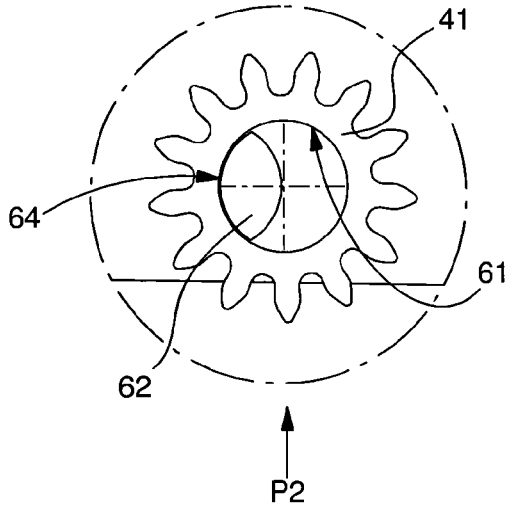
Figure 10C:
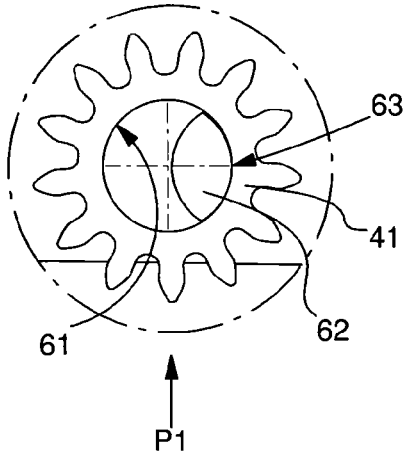
Figure 11A:
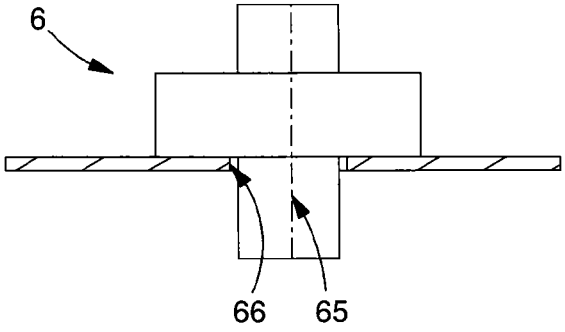
FIGS. 11A, 11B, 11C, 11D show schematic, partial views, in cross-section in FIG. 11A and in front views in the other Figures, of a detail of a mechanism for coupling or uncoupling the stem relative to an intermediate winding mechanism, in the variant of FIGS. 2 to 4.
Figure 11B:
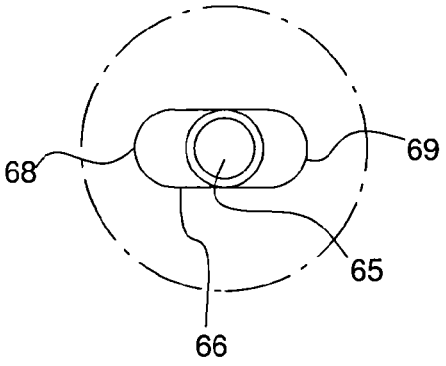
Figure 11C:
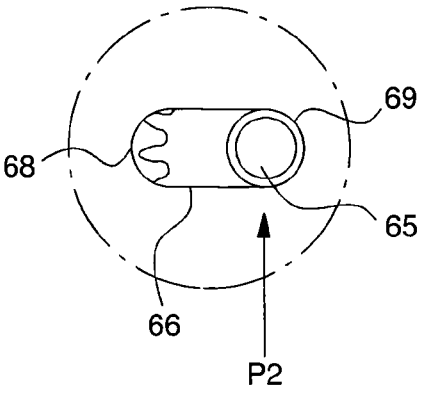
Figure 11D:
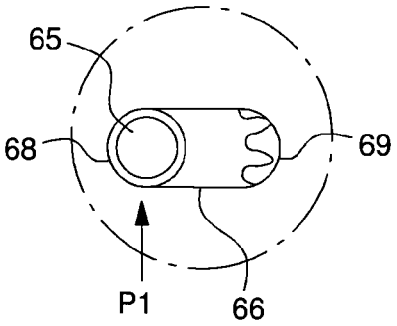
Figure 12:
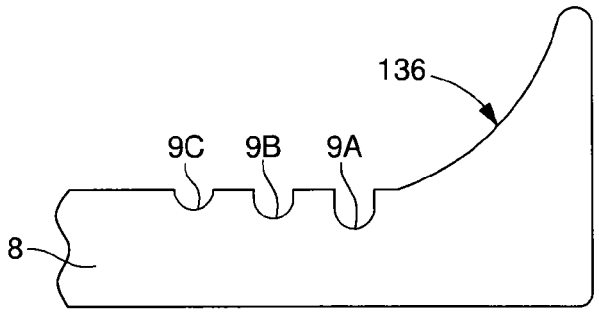
FIG. 12 shows a schematic, partial, front view of a detail of a spring forming an elastic return means for the stem which can be used in the different variants.

According to the invention, a portion of the length stem 3 is ringed or threaded to drive intermediate winding wheel 6, or winding lever 42, as appropriate, when the stem is in the initial stable position T0, which is preferably a pushed-in position of stem 3, and another portion of the length of stem 3 is preferably free so as to remain at a distance from intermediate winding wheel 6, or respectively winding lever 42, over a portion of the travel thereof when stem 3 is in another stable position T1, T2, preferably pulled-out with respect to the initial pushed-in stable position T0, as seen in FIGS. 8 and 9. In FIGS. 8 and 9, cylindrical bore 61 occupies the disengaging position P2 where bore 61 abuts on the second surface 64, as seen in FIG. 10C. Intermediate winding wheel 41 is then disengaged from the winding train.

In a conventional embodiment, one of the positions T1, T2 is for setting the motion work 18A and the other for setting the date 156. Usually, position T1 is dedicated to setting the date and position T2 to setting the time. In each of these stable positions, the direction of pivoting of stem 3 may correspond to a different setting: and other stable longitudinal positions may be envisaged. It is therefore possible to perform complementary adjustments for the day of the week, the moon phase, time zone, time of the day AM/PM, or other settings, depending upon the complications comprised in timepiece 100.

In a particular arrangement, threaded stem 31 includes a threaded portion in the form of a worm, arranged to cooperate with a star wheel or toothing comprised in intermediate winding wheel 6, or comprised in an intermediate train cooperating with intermediate winding wheel 6.

Figure 6:
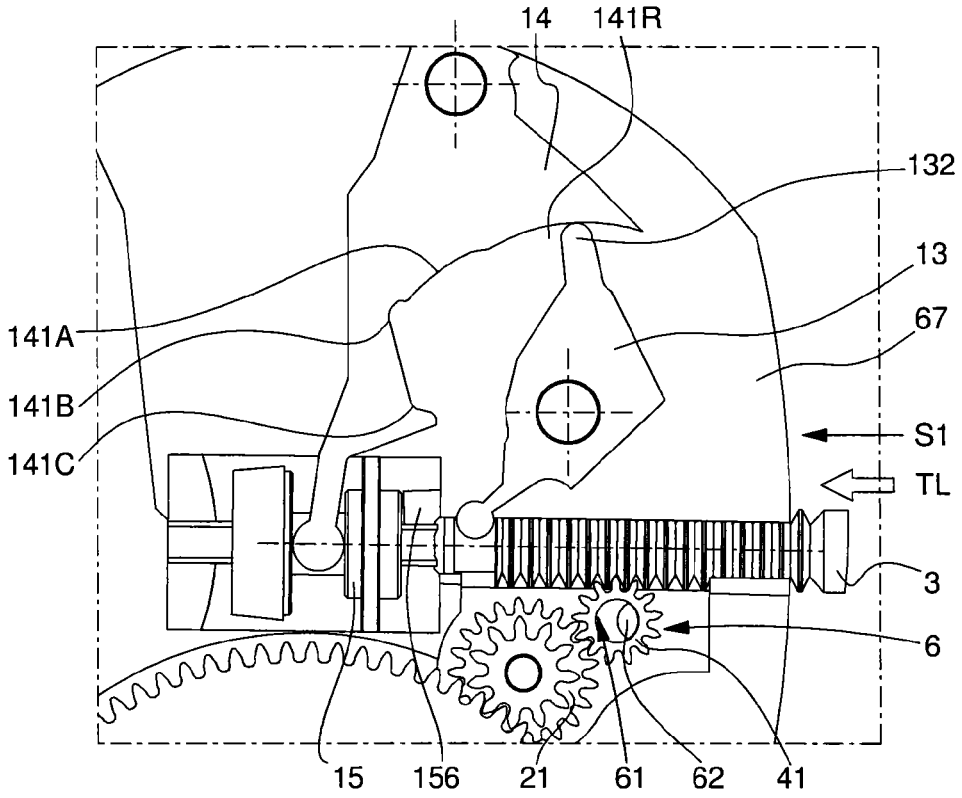
FIG. 6 shows, in a similar manner to FIG. 5, the same mechanism as the stem is being pushed in from this initial position in a first direction of operation.
Figure 7:
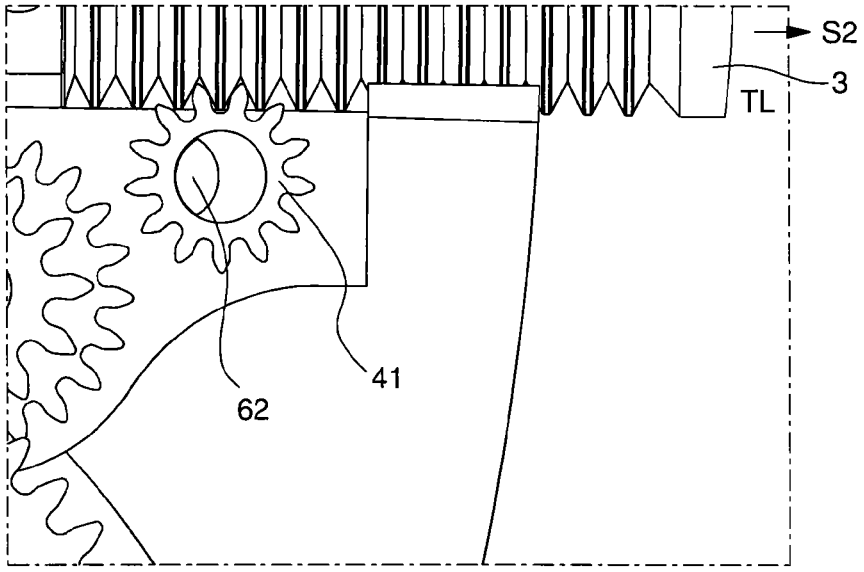
FIG. 7 shows, in a similar manner to FIG. 5, the same mechanism as the stem returns from a pushed-in position obtained by the operation of FIG. 6, to the initial position, as a result of elastic return means, in a second direction of operation, opposite to the first.

In a variant where stem 3 controls the movement of castle-wheel 5 by a combination of pull-out piece 13 and a second lever 14, this second control lever 14 for moving castle-wheel 15 in translation includes, as seen in FIGS. 2 to 4, a path 141 including several stop positions 141A, 141B, 141C. These stop positions are each arranged to cooperate with a finger 132 comprised in pull-out piece 13 or a lever hinged on said pull-out piece 13. Each of these stop positions corresponds to a stable position of stem 3, one of these positions 141A corresponds to the initial stable position T0 of stem 3, in which winding is possible, and the other position 141B, or the other positions 141B, 141C, . . . , corresponds or correspond to a stable position or positions T1, T2, . . . , of stem 3, in which winding is impossible and at least one adjustment is allowed. The winding range corresponds to the distance covered by a path 141R as seen in FIGS. 6 and 7.

In a particular embodiment, this second control lever 14 for moving castle-wheel 15 in translation includes a secondary pivot 8B for hooking a pull-out piece spring 133 forming spring 8 of elastic return means 5. This pull-out piece spring 133 includes several notches 9A, 9B, 9C and is hooked by a main pivot 8A to pull-out piece 13, or to a lever hinged to pull-out piece 13. In this particular configuration, pull-out piece spring 8 does not pivot, and pivots 8A and 8B form, as regards spring 8, simple hooking pins.

This pull-out piece 13, or lever hinged to pull-out piece 13, includes a pin or finger 131 arranged to cooperate with one of notches 9A, 9B, 9C of pull-out piece spring 133. Each of the positions of cooperation of this pin or finger with one of notches 9A, 9B, 9C corresponds to a stable position of stem 3, one of these positions 9A corresponds to the initial stable position T0 of stem 3 in which winding is possible, and other position or positions correspond to a stable position or positions T1, T2, . . . , of stem 3, in which winding is impossible and at least one adjustment is allowed.

In a preferred embodiment, this pull-out piece spring 133 includes, after notches 9A, 9B, 9C, a ramp 136 for exerting a return force, or to allow motion.

In a particular embodiment seen in FIG. 13, mechanism 1 includes, as elastic return means 5, at least one stem spring 8, arranged to resist pressure by the user on stem 1 during winding. Said stem spring 8 is prestressed achieved by a stop member 8C comprised in a bar or bottom plate 67 of mechanism 1 or movement 10 or timepiece 100.

In an advantageous embodiment for a movement 10 including a date display, castle-wheel 15 includes, on both sides of a groove 151 for cooperating with the second lever 14 controlling the movement of castle-wheel 15, on the one hand, a front toothing 152 for cooperating with a motion work 18A, and on the other hand an inclined face or helical ramp 153, one projecting end 154 of which is arranged to cooperate with an inner toothing 155 of a date indicator ring 156, in one direction only.

Advantageously, castle-wheel 15 is made of synthetic material or plastic material.

According to a particular feature of the invention, the control mechanism 1 is contained between two parallel planes separated by the maximum diameter value of castle-wheel 15.

The advantage of the invention is that the strong thrust force that the user can provide is dedicated to the function that requires the least torque.

It is clear that the invention concerns any energy accumulator 20 that can be used in a timepiece 100, whether it is a barrel 220 for driving a movement 10, as illustrated in the Figures, or a barrel for driving a striking or other mechanism.

It is also perfectly possible to envisage applying the principle of the invention to loading an electrical energy accumulator, to light a dial or a luminous watch display.

Likewise, the effect of a pressing or pulling movement can, suitably transformed by mechanism 1 according to the invention, be used to modify or create an electrical and/or magnetic field.

Thus "winding" should therefore be understood to include any energy loading of an energy accumulator.

The mechanism which is wound by pressure on the stem overcomes the drawbacks of the prior art, and further proposes an original alternative to the conventional winding mechanism.

In the versions illustrated in FIGS. 2 to 9, the positions of stem 3 correspond to the following functions:

- first initial position T0, if the winding-button is rotated: neutral, i.e. no effect on winding or on setting the time or date;
- initial first position T0, if the winding-button is pressed or pulled as appropriate: winding action and no effect on setting the time or date;
- second position T1, if the winding-button is rotated; correction of the time or date respectively, and no effect on winding;
- second position T1, if the winding-button is pressed: the ringed or threaded portion of the stem is no longer in mesh with the intermediate winding wheel or lever, no effect on setting the time or date. In a version where stem 3 is a ringed stem 32, there is also no effect on winding. Conversely, if stem 3 is a threaded stem 31, if the winding-button is rotated in the direction of screwing-in, there may be an effect on winding.
- third position T2, if the winding-button is rotated: correction of the date or time respectively, and no effect on winding if stem 3 is a ringed stem 32;
- third position T2, if the winding-button is pressed: the ringed or threaded portion of the stem is no longer in mesh with the intermediate winding wheel or lever, no effect on winding, and no effect on setting the time or date.

The effect on winding is variable, depending upon the stem operating sequence: there is no effect on winding during a change from T0 to T1, then to T2. However, an effect is possible, depending upon the length of the stem, during a change from T2 to T0, from T2 to T1, from T1 to T0.

Mechanism 1 is studied so that it can be entirely integrated in a much reduced volume, and can thus occupy a height corresponding to the diameter of the castle-wheel, including the various intermediate wheels up to the ratchet.

In short, in the non-limiting versions illustrated in the Figures, and in an embodiment with a small number of components, the invention consists in:

- replacing the conventional stem with a ringed or threaded stem comprising a groove for guiding the pull-out piece arm, and a square hole for guiding a castle-wheel;
- replacing the Breguet toothing winding pinion with an intermediate winding wheel or winding lever;
- replacing the usual crown wheel with an intermediate ratchet meshing wheel;
- in a particular embodiment, replacing the usual Breguet toothing castle-wheel with a simplified castle-wheel, which includes, on both sides of a groove cooperating with the lever, on the one hand, for a time display mechanism, a front toothing for cooperating with the motion work, and on the other hand, for date-setting, an inclined face or a helical ramp portion, a projecting end of which is arranged to cooperate with the inner toothing of a date indicator ring, in one direction only;
- integrating the lever spring in the actual lever;
- modifying, or omitting, the usual pull-out piece jumper spring;
- in a particular embodiment, making the new simplified castle-wheel in synthetic material, for example by injection moulding;
- making the stem by screw cutting;
- making the pull-out piece and the lever in flat, cut out portions.

The invention is then very economical to produce.

The height of the mechanism can then be reduced to the diameter of the new castle-wheel, for example 1.5 mm.

The Breguet toothings are omitted, which is a significant saving.

The usual 90° gearing between the winding pinion and the crown wheel is omitted.

The date correction function in the first intermediate pulled-out position and the time correction function in the second entirely pulled-out position of the stem are achieved in a conventional manner, with a simple mechanism.

The main winding function is only possible in one particular position of the stem, i.e. preferably the pushed-in position of the stem, and is preferably performed by pushing in the stem.

The kinematics of the pull-out piece and lever is achieved, in a particular method of separating the functions, so that the castle-wheel remains at a distance both from the motion work and the date ring, when the stem is in the initial position T0 in which winding is possible.

The translation of the ringed portions of the stem drives the new intermediate winding wheel, which, when the stem is pushed in, tends to be guided on an external portion of the almond-shaped arbour by which it is carried, which thus causes said wheel to cooperate with the intermediate meshing wheel of the ratchet.

The stem may also be mounted on a spring which tends to move the stem out of the case.

The barrel is completely wound by several applications of pressure, without any significant force on the part of the user.

Thus the winding, time and date setting functions are perfectly separate.

The invention also concerns a timepiece movement 10 fitted with this type of control mechanism 1.

The invention also concerns a timepiece 100 fitted with at least one movement 10 of this type, and/or one control mechanism 1 of this type.

The mechanism according to the invention is particularly well suited to making an ultra-flat watch.

What is claimed is:

1. A control mechanism for loading an energy accumulator for a timepiece or a timepiece movement via an intermediate winding mechanism, comprising:

said intermediate winding mechanism including a winding stem and a winding-button arranged to drive said stem, at least in translation, wherein said stem is configured to occupy at least an initial longitudinal position for said energy loading, and a portion of the length of said stem is a ringed stem or a threaded stem, said stem is arranged to drive in at least one of rotation and translation a winding driver, when said stem is moved in translation as a result of pressure or respectively traction by a user, in a travel which is limited between said initial longitudinal position and a maximum pushed-in or respectively pulled-out position of said stem, said maximum position being an unstable position, and said stem being returned to said initial position by an elastic return part, wherein said winding driver includes a driving part to drive said intermediate winding mechanism, and wherein said driving part includes a disconnectable intermediate winding wheel to drive a winding train, comprised in said intermediate winding mechanism, said disconnectable intermediate winding wheel being moveable along a travel parallel to that of said stem and remaining permanently meshed with said stem, and wherein said stem is arranged to pivot the disconnectable intermediate winding wheel to drive said driving part of said intermediate winding mechanism, and said disconnectable intermediate winding wheel is moveably mounted and configured to occupy two positions; a gearing position in which said disconnectable intermediate winding wheel is meshed with said driving part when said stem is moved in translation in a first direction of winding as a result of pressure or respectively traction by the user against said elastic return part; and a disengaging position in which the disconnectable intermediate winding wheel is disengaged from said driving part when said stem is moved in translation in a second, return direction opposite to said first winding direction by said elastic return part.

2. The control mechanism according to claim 1, wherein said winding-button is further arranged to pivot said winding stem which, in addition to said initial energy loading position via a movement of translation of said stem, is configured to occupy at least one other longitudinal position for setting a display mechanism via a pivoting movement of said stem.

3. The control mechanism according to claim 1, wherein said stem is arranged to drive, by a guide groove, directly or indirectly via at least a first lever, a first arm of a pull-out piece arranged to control directly or indirectly, via at least a second lever, the movement of a castle-wheel on a translation guiding part comprised in said stem, said castle-wheel has only one degree of freedom in translation relative to said stem and rotates integrally therewith by a rotational driving part, in order, according to the longitudinal position of said castle-wheel on said stem, either to mesh said castle-wheel with an adjusting wheel set to set the display of a function of said timepiece or said timepiece movement or meshing said castle-wheel with a wheel set linked to another function of said timepiece or said timepiece movement, or to bring said castle-wheel into a neutral position in which said castle-wheel has no effect on the functions of said timepiece or said timepiece movement.

4. The control mechanism according to claim 3, wherein one said adjusting wheel set is a minute wheel set to set the time of said timepiece or said timepiece movement.

5. The control mechanism according to claim 1, wherein said elastic return part includes at least one spring integrated in at least one lever inserted between said stem and an arm of a pull-out piece controlling the movement of a castle-wheel.

6. The control mechanism according to claim 1, wherein said elastic return part includes at least one spring working in compression, respectively traction, to push or respectively pull said stem when the stem is pushed into said timepiece or respectively pulled out of said timepiece by the user, from said initial stable longitudinal position towards said unstable maximum pushed-in or respectively pulled-out position of said stem, and said elastic return part also forms an element to index the longitudinal position of said stem in at least one other stable position, different from said initial position and cooperating, via at least one notch, with a finger comprised in a pull-out piece actuated by said stem and controlling the movement of a castle-wheel.

7. The control mechanism according to claim 1, wherein said intermediate winding wheel includes a cylindrical bore guided on an arbour of almond-shaped section, which allows said wheel to occupy said gearing position when said bore abuts on a first surface of said arbour, and said disengaging position when said bore abuts on a second surface, opposite said first surface.

8. The control mechanism according to claim 1, wherein said intermediate winding wheel includes an arbour which is movable in an oblong hole in a bar or a bottom plate, between two stop members; allowing said wheel to occupy said gearing position when said arbour abuts on a first stop member of said oblong hole, and said disengaging position when said arbour abuts on a second stop member of said oblong hole.

9. The timepiece movement including at least one control mechanism according to claim 1.

10. The timepiece including at least one of:

at least one control mechanism according to claim 1, and at least one of the timepiece movement that includes at least one control mechanism according to claim 1.

* * * * *